United States Patent [19]

Hanna

[11] Patent Number: 4,703,800

[45] Date of Patent: Nov. 3, 1987

[54] METHOD FOR CONSOLIDATING FORMATION SURROUNDING BOREHOLE

[76] Inventor: Mohsen R. Hanna, Box 699, Station "G", Calgary, Alberta, Canada, T3A 2G5

[21] Appl. No.: 880,035

[22] Filed: Jun. 30, 1986

Related U.S. Application Data

[63] Continuation-in-part of Ser. No. 603,729, Apr. 25, 1984, abandoned.

[51] Int. Cl.[4] ..... E21B 33/138

[52] U.S. Cl. ..... 166/288; 166/302; 166/295

[58] Field of Search ..... 166/288, 276, 302, 294, 166/303, 250

[56] References Cited

U.S. PATENT DOCUMENTS

| | | | |
|---|---|---|---|
| 3,003,555 | 10/1961 | Freeman et al. | 166/288 |
| 3,104,705 | 9/1963 | Ortloff et al. | 166/288 |
| 3,147,805 | 9/1964 | Goodwin et al. | 166/288 |
| 3,292,701 | 12/1966 | Goodwin et al. | 166/288 |
| 3,483,926 | 12/1969 | Bruist | 166/288 |
| 3,522,845 | 8/1970 | Bauer | 166/288 |
| 3,812,913 | 5/1974 | Hardy et al. | 166/288 |
| 3,871,455 | 3/1975 | Hardy et al. | 166/288 |
| 3,910,351 | 10/1975 | Wu et al. | 166/288 |
| 3,974,877 | 8/1976 | Redford | 166/276 |
| 4,501,328 | 2/1985 | Nichols | 166/276 |

*Primary Examiner*—Stephen J. Novosad
*Assistant Examiner*—Bruce M. Kisliuk
*Attorney, Agent, or Firm*—William D. Parks; Raymond N. Baker

[57] ABSTRACT

There is disclosed a process for transforming an unconsolidated formation surrounding a borehole into a consolidated state for the prevention of the migration of small particles during the removal of fluid from the borehole. The formation is heated to a predetermined temperature capable of supporting low temperature oxidation, precipitation of asphaltenes occurs in the formation upon injection of unheated air, without fracturing the formation, into the borehole and results in consolidation of the formation.

19 Claims, 2 Drawing Figures

METHOD FOR CONSOLIDATING FORMATION SURROUNDING BOREHOLE

This applicaton is a continuation-in-part of co-pending U.S. patent application, Ser. No. 603,729, filed Apr. 25, 1984 now abandoned.

BACKGROUND OF THE INVENTION

This invention relates to a method of treating an unconsolidated formation surrounding a borehole.

Numerous processes have been proposed for consolidating subterranean formations surrounding a borehole to prevent sand particles flowing from an unconsolidated formation into the borehole with the fluids being pumped from the borehole. Migration of the sand particles not only fill in the borehole and cause deterioration of the walls of the borehole, but can cause considerable damage by flowing into the system removing the fluid from the borehole. If properly consolidated, the formation can act as a filter in that it permits the flow of the fluid into the borehole while holding back any loose particles which would be otherwise carried by the fluid flowing out of the formation. In areas where oil is too heavy to flow naturally into boreholes, large areas of the subterranean formation containing the heavy oil are heated by forcing steam down the boreholes and into the formations so as to reduce the viscosity of the oil. In this type of operation the consolidated formation must not only be sufficiently permeable to permit the flow of the oil into the borehole, but it must be able to withstand the flushing of steam from the borehole into the formation for long periods of time. While the known processes may be operable to develop at least some degree of consolidation, the resulting permeability may not be acceptable, the formation may not retain the consolidation, or the process may be expensive and may not be practical, for example, in a borehole which is not thermally completed well.

Prior processes have been described which involve injecting plastic materials into the unconsolidated sand so as to provide a resinous plastic material for bonding the sand particles together. U.S. Pat. No. 4,232,740, Nov. 11, 1980 of Jack H. Park proposes a method which requires contacting the sand with an aqueous solution of calcium hydroxide, plus an effective amount of calcium salt having solubility greater than calcium hydroxide, such as calcium chloride, plus an alkalinity agent such as sodium hydroxide. It is explained in the U.S. Patent that the well may be enlarged and sand of a preferable particle size or size range introduced into the formation prior to treatment.

U.S. Pat. No. 3,072,188, Jan. 8, 1963, of Richard A. Morse describes a method of heating a borehole of a well in which the borehole is packed with a refractory material and the borehole is heated by igniting a fuel-air mixture which has been injected into the borehole. The combustion which results is described as reverse combustion, i,e. the direction of movement of the combustion front through the permeable medium is opposite to the direction of movement of the fuel-air mixture and products of combustion. It is explained that a temperature of at least about 800° F. may be necessary to cause hydrocarbons in the formation to coke.

U.S. Pat. No. 3,147,805, Sept. 8, 1964, of Robert J. Goodwin et al, disclosed a method of injecting a heated oxygen containing gas, which may contain a mixture of combustion products, into a borehole and increasing the temperature of the gas to thereby heat the formation to a temperature to form coke.

U.S. Pat. Nos. 3,254,716, June 7, 1966, of Benny M. Fitzgerald et al, and 3,974,877, Aug. 17, 1976, of David A. Redford both disclose a method of injecting a mixture of steam and air into a borehole to provide a consolidated formation, the steam being utilized in an attempt to avoid combustion occurring in the formation. U.S. Pat. No. 3,254,716 describes the injection being carried out for a sufficient time and at a temperature to form a bonding by the formation of coke. In the preferred method disclosed in U.S. Pat. No. 3,974,877 a sand or gravel pack is formed around a borehole and saturated with bituminous petroleum, and the pack is then subjected to an injection of a mixture of steam and air to form a coke like material.

Because the borehole is exposed to various substances, it is believed that formations which have been consolidated by the addition of plastic materials or treatment by various chemical substances may experience rapid deterioration or loss of permeability. The processes which utilize relatively high heat to achieve coking may result in an exceptionally hard and durable formation, but the resulting formation may not be sufficiently permeable to permit a good flow of fluid therethrough. The use of steam with hot air is not believed to be a satisfactory solution to avoid coking due to combustion because the steam has an abrasive action tending to weaken the consolidation. Moreover, the steam reduces the oil saturation around the borehole, and this results in a weaker formed consolidation immediately adjacent the borehole. Additionally, the use of steam with the air is not practical for wells which are not thermally completed.

SUMMARY OF THE INVENTION

It is an object of the present invention to provide an economical treatment which will provide an acceptable consolidation of the formation and can be used on any well whether or not steam is available.

According to the present invention there is provided a method of forming a permeable consolidation formation by first heating the unconsolidated formation which is present in its natural form around the borehole, the formation being heated to a temperature which is only sufficient to support low temperature oxidation of the oil contained within the formation, and then injecting at a low rate to avoid fracturing the formation an unheated oxygen-containing gas, which would normally be air, into contact with the heated formation for a predetermined time so as to consolidate the formation by way of the precipitation of asphaltenes in the formation.

In a preferred embodiment a small volume of crude oil, preferrably from 40 to 50 cubic meters for a 500 meter borehole, is heated at the ground surface to approximately 100° C., and this heated crude oil is injected, without fracturing the formation, into the borehole vicinity to a depth of about 3 to 6″ to raise the temperature of the borehole vicinity to about 35° C. to 50° C.

In a specific embodiment of the invention, an oil bank is maintained in the portion of the borehole to be treated and the heating is carried out by operating an electric heater in the oil bank so as to heat the unconsolidated formation to a predetermined temperature for a predetermined depth away from the borehole. The oil is then forced from the oil bank and into the surrounding formation before the air at substantially atmospheric temperature is injected into the borehole.

BRIEF DESCRIPTION OF THE DRAWINGS

In the accompanying drawings which illustrate one embodiment of the invention, by way of an example.

DESCRIPTION OF THE INVENTION

Figure 1:
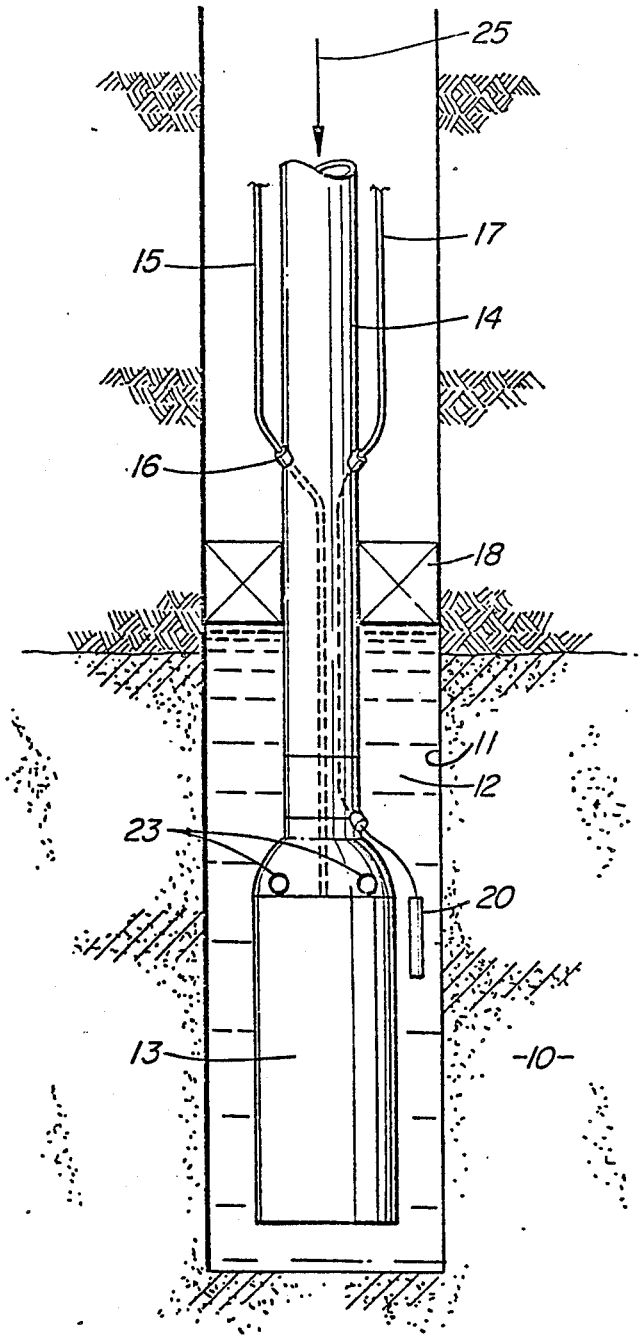
FIG. 1 is a diagrammatic view, partially in cross section, of an apparatus in a borehole during a heating step.

Tests were conducted for the purpose of observing the effectiveness of utilizing low temperature oxidation reactions as a method for consolidating well bores in unconsolidated sand reservoirs, low temperature oxidation usually meaning reactions which occur between oxygen and hydrocarbons at temperatures below 300° C. One phase of the tests involved the use of oil samples obtained by decanting Kitscoty oil directly from the filed supplied containers. The samples were not cleaned prior to the test, and therefore, some water was present with the oil. The oil samples were placed in temperature controlled rotary evaporators, and while the samples were maintained at different temperatures, air was purged through the oil. Two separate tests were conducted at 135° in order to observe the effect of time on the oxidation process.

Table 1 presents a comparison between the oxidized oil samples and an original sample. The data shows that the oxidation process resulted in an increase in the asphaltene content of the oil at all temperatures. The increase in asphaltene content seems to have a significant effect on the oil viscosity. Oil sample densities also increased with degree of oxidation.

A comparison of the two oxidation tests at 135° C. shows that a significant portion of the asphaltenes formed during the initial 24 hour period. While the increase in asphaltene content is only 3.1 mass percent during the 24 to 42 hour period, the viscosity at 135° C. for the 42 hour sample is significantly greater than that of the 24 hour sample.

TABLE I

SUMMARY OF OXIDIZED OIL PROPERTIES[3]

| TEMPERATE (°C.) | TIME (hrs) | DENSITY (25° C.) (gm/cc) | VISCOSITY (mPa.s) 110° C. | VISCOSITY (mPa.s) 130° C. | ASPHALTENES[1] (mass percent) | COKE & RESIDUE[2] (mass percent) |
|---|---|---|---|---|---|---|
| Original | — | 0.9754 | 38 | 11 | 14.7 | 0.4 |
| 38 | 42 | 0.9849 | 55 | 29 | 15.4 | 1.0 |
| 100 | 42 | 1.0045 | 260 | 96 | 23.2 | 1.0 |
| 135 | 42 | 1.0227 | >1200 | 1100 | 33.1 | 1.0 |
| 135 | 24 | 1.0191 | — | 380 | 30 | — |

[1]Pentane Insoluble Fraction
[2]Toluene Insoluble Fraction
[3]Oil Sample was obtained from the 3C-2-51-2W4M well. Viscosities in above table are comparable to those reported by United Petro Labs.

It is apparent from the above, that Kitscoty oil is reactive with oxygen at temperatures as low as 38° C. and that the asphaltene content of the oil increases with temperature for a fixed contact time and also with time for a fixed temperature. It is also apprent that both oil density and viscosity undergo significant alteration during the low temperature oxidation process.

Additional tests were conducted for the purpose of observing the effectiveness of low temperature oxidation at 200° C. under an overburden pressure of 1500 p.s.i. as a means for consolidating core material and of obtaining qualitative permeability to water data. Core plugs were obtained from the Home Esso Lloyd 3B-2-51-2W4M well.

The oxidation portion of the test was conducted by injecting compressed air directly from the cylinder. The rate of air injection was controlled by a manual needle valve. A wet test meter located downstream of the back pressure valve was used to meter the air injection rate.

A positive displacement pump was used for water injection. The rate of injection was manually controlled based on the water height in a feed burette.

Core plugs were cut and stacked in a lead sleeve according to the order shown in Table 2. The stacked core length was 24.13 cm. The mounted core was sealed in the core holder and the heater activated to obtain the desired oxidation temperature of 200° C. Air injection commenced when the temperature attained the desired level and was terminated following a 24 hour period. Water was then injected at a temperature of 200° C. and a pressure of 3447 kPa for 24.3 hours. Differential pressure measurements were obtained at the start and end of the water injection phase in order to determine the core permeability to water.

On completion of the 24.3 hour hot waterflood period, the core temperature was raised to 236° C. and the back pressure was reduced to 2848 kPa to achieve steam injection conditions. Steam was injected for a period of 23.8 hours. The system was then allowed to cool to ambient temperature and the permeability to water again determined.

Table 3 presents a summary of the test sequence for the Consolidation Test. As stated previously, the core was oxidized at 200° C. for 24 hours, hot waterflooded for 24.3 hours at 200° C. and steamflooded for 23.8 hours at 236° C. The volumes of hot water and steam injected, correspond to 13.6 pore volumes and 20.8 pore volumes respectively. Permeability values determined following each injection sequence, showed that the permeability to water increased from 8 millidarcies for the oxidized core to 12 millidarcies following hot water injection. It should be noted that the relative permeability to water before and after oxidation did not change much indicating that the air does not have a significant effect on the relative permeability to water. The steam injection of 20.8 pore is a relatively large volume, and the results therefore indicate that the consolidation is fairly strong and lasting.

Following steamflooding the permeability increased to 428 millidarcies. It is of interest to note that the hot waterflood resulted in only a minor change in the core permeability to water and that the significant permeability increase was associated with the steamflood. (See Table 3). The increase in permeability of the consolidation is an indication of the abrasive and loosening effect of the steam; and it is believed that the effect would be present if steam was injected with air for the purpose of heating the formation in accordance with the prior art, so as to result in a weaker consolidation.

A summary of the core analysis following Consolidation Test is given in Table 4. The core was divided into three sections for the purpose of analysis with the top portion corresponding to the injection end of the core. The post consolidation core analysis shows that very little oil remained in the core (0.53,0.0 and 1.3 mass percent for the top, middle and bottom part of the core respectively). The toluene insoluble (usually defined as coke) fraction is seen to vary from 3.9 mass percent for the bottom zone to 5.8 mass percent for the middle zone.

Visual inspection of the core showed the middle and bottom sections to be black in color and well consolidated. The top core section showed channels of clean sand which indicated a lower degree of consolidation in these channels. While this top zone was not as well consolidated as the middle and bottom sections, it was consolidated to the extend that sand grain movement was retarded.

Thus, injection of air for a 24 hour period at a temoerature of 200° C. resulted in excellent consolidation of core plugs from the Kitscoty pilot. Permeability measurements on the confined core showed that the permeability to water, increased from 8 millidarcies for the core following the oxidation phase to 428 millidarcies following steam injection. The permeability to water before oxidation as determined from the Kitscoty steamflood was approximately 7 millidarcies. This indicates that the presence of air results in only a minor change in the relative permeability to water.

TABLE 4-continued

| POST CONSOLIDATION CORE ANALYSIS | | | |
|---|---|---|---|
| | | PERCENT COMPONENTS | |
| ZONE | MASS OIL(1) | ASPHALTENES(2) | COKE(3) |
| Middle | 0.00 | N/A | 5.8 |
| Bottom | 1.3 | 5.6 | 3.9 |

(1)Mass Percent of the dry core sample.
(2)Pentane insoluble fraction expressed as mass percent of the oil fraction.
(3)Tolene insoluble fraction expressed as mass percent of the dry core sample.

Prior to commencing treatment of the unconsolidated formation in a borehole the oil associated with the borehole and the formation are tested to establish the predetermined temperature to be used and the duration of the air injection. An example of a test of the oil from the Leismer well is given below in Table 5.

The oil supplied was obtained from the Leismer 10-14-76-7W4 well. Water was separated from the oil prior to the test program.

The tests were conducted by placing the oil sample in temperature controlled rotary evaporators. Air was continuously purged through the oil during the 24-hour test period.

Table 5 presents a comparison between the oxidized oil samples and an original oil sample. All oxidized samples show an increase in asphaltenes content following the 24-hour test period.

Asphaltenes content are observed to increase from the original level of 19.1 mass percent for the original sample to 19.4, 23.9 and 32.7 mass percent for the 40° C., 100° C. and 135° C. oxidized sample respectively. It is interesting to note that while the asphaltene content of the oil increase with the degree of oxidization, no perceptible change was observed in the toluene insoluble (coke) fraction.

TABLE 2

| CORE SAMPLE SUMMARY FOR CONSOLIDATION TEST | | | | | |
|---|---|---|---|---|---|
| STACK(1) NO. | SAMPLE(2) NO. | AVERAGE BULK(2) MASS FRACTION OIL | PERMEABILITY(2) TO AIR (DARCIES) | POROSITY(1) % | CORE DEPTH(2) (METERS) |
| 1 | 0B1 | 0.136 | 2.01 | 35.8 | 569.57-570.62 |
| 2 | 0B2 | 0.136 | 3.05 | 33.7 | 570.62-571.35 |
| 3 | 0B17 | 0.088 | 3.10 | 29 | 596.53-599.15 |
| 4 | 0B18 | 0.08 | 5.24 | 29 | 599.15-600.97 |
| 5 | 0B19 0.039 | 2.41 | 24.4 | 600.97-603.3 | |
| 6 | 0B19 | 0.039 | 2.41 | 24.4 | 600.97-603.3 |

(1)Stack number refers to core plug location as measured from the inlet or top end of core holder.
(2)Core Laboratories - Canada Ltd., File 7006-80585, November 24, 1980.

TABLE 3

| TEST SEQUENCE FOR CONSOLIDATION TEST (CONFINED CORE) | | | | | | |
|---|---|---|---|---|---|---|
| FLUID INJECTION | DURATION (HRS) | TEMPERATURE °C. | INJECTION PRESSURE (kPag) (psig) | AIR INJECTION RATE (LITERS/MIN)(1) | WATER INJECTED (g) (P.V.)(2) | PERMEABILITY TO WATER (MILLIDARCIES) |
| Air | 24 | 200 | 3413 - 495 | 1.4 | — — | 8(4) |
| Hot Water | 24.3 | 200 | 3447 - 500 | — | 1101 - 13.6 | 12 |
| Steam | 23.8 | 236 | 2848 - 413 | — | 1684 - 20.8(3) | 428 |

(1)Volume defined at 15° C. and 101.325 kPa
(2)Based on mean porosity of 0.294 and core volume of 275.1 $cm^3$
(3)Measure as volume of injected water
(4)Same range as before oxidation

TABLE 4

| POST CONSOLIDATION CORE ANALYSIS | | | |
|---|---|---|---|
| | | PERCENT COMPONENTS | |
| ZONE | MASS OIL(1) | ASPHALTENES(2) | COKE(3) |
| Top | 0.53 | 3.7 | 4.2 |

The increasing asphaltenes content has a significant effect on the dynamic viscosity of the oil. Viscosities measured at 110° C. are observed to increase from 140 mPa.s for the original oil to greater than 1200 mPa.s for the sample oxidized at 135° C.

A comparison between the original oil viscosities and those of the sample oxidized at 40° C. shows that the oxidized oil has a significantly high viscosity at 110° C. but essentially the same viscosity at 130° C. This observed change in the effect of temperature on the viscosity is characteristic of oxidized oil.

Another characteristic of oxidized oils is an increase in density with degree of oxidation. The oil densities are observed to increase from 1.003 gm/cm$^3$ for the original oil to 1.0319 gm/cm$^3$ for the sample oxidized at 135° C.

On the basis of the above tests, it was initially concluded that a temperature of 100° C. and a 24 hour air injection be utilized would be a reasonable set of conditions. However, it was thought best to conduct consolidation tests on an unconfined core also obtained from the same well before selecting the exact values for temperature and of duration.

TABLE 5

LEISMER OXIDATION STUDY
SUMMARY OF OXIDIZED OIL PROPERTIES

| TEMPERATURE °C. | OXIDATION TIME h | DENSITY (25° C.) gm/cm$^3$ | DYNAMIC VISCOSITY (mPa s) 110° C. | 120° C. | 130° C. | ASPHALTENES[1] (mass percent) | COKE[2] (mass percent) |
|---|---|---|---|---|---|---|---|
| original | | 1.0030 | 140 | 96 | 68 | 19.1 | — |
| 40° C. | 24 | 1.0045 | 190 | 130 | 67 | 19.4 | <0.1 |
| 100° C. | 24 | 1.0176 | 530 | 300 | 180 | 23.9 | <0.1 |
| 135° C. | 24 | 1.0319 | >1200 | 890 | 470 | 32.7 | <0.1 |

[1]Pentane Insoluble Fraction
[2]Tolene Insoluble Fraction

Tests which have been conducted in boreholes seem to indicate that to obtain adequate consolidation by the present method, the heat must only penetrate the formation surrounding the borehole to a depth of about 6 inches. Having determined the desired temperature for the formation the following formula may be utilized in calculating the temperature to be used for a particular duration. The example used illustrates the use of the formula in bringing the temperature of the formation up to 135° C.

$$\frac{T - T_0}{T_1 - T_0} = 1 - Y = ERFC\frac{X}{2\sqrt{\alpha t}}$$

WHERE:

$\alpha$=DIFFUSIVITY IN FT$^2$/HR=0.057 FT$^2$/HR $T_1$ & $T_0$=WELLBORE AND RESERVOIR TEMPERATURE RESPECTIVELY t=TIME IN HRS.

X=DISTANCE TO BE HEATED IN FT

THUS FOR: X=½ FT

| TIME (DAY) | 1 − Y |
|---|---|
| 0.167 | 0.460 |
| 0.5 | 0.671 |
| 1 | 0.76 |
| 3 | 0.869 |
| 6 | 0.902 |

THUS TO HEAT UP 6 INCHES TO 135° C. THE WELLBORE SHOULD BE KEPT AT 173° C. FOR 24 HRS.

$$0.76 = 1 - Y = \frac{T - T_0}{T_1 - T_0} = \frac{T - 16}{173 - 16}$$

-continued
$T$ = 135° C.

Further experimenting revealed that in situations where the oil in a well is sufficiently heavy to require stimulation in the oil extraction process, such as by steam stimulation, highercohesive strength in consolidation is required and temperature in the order of 135° C. may be justified. However, in a primary well, which does not require stimulation during production, a much lower temperature, such as 35° C., is sufficient.

Figure 3:
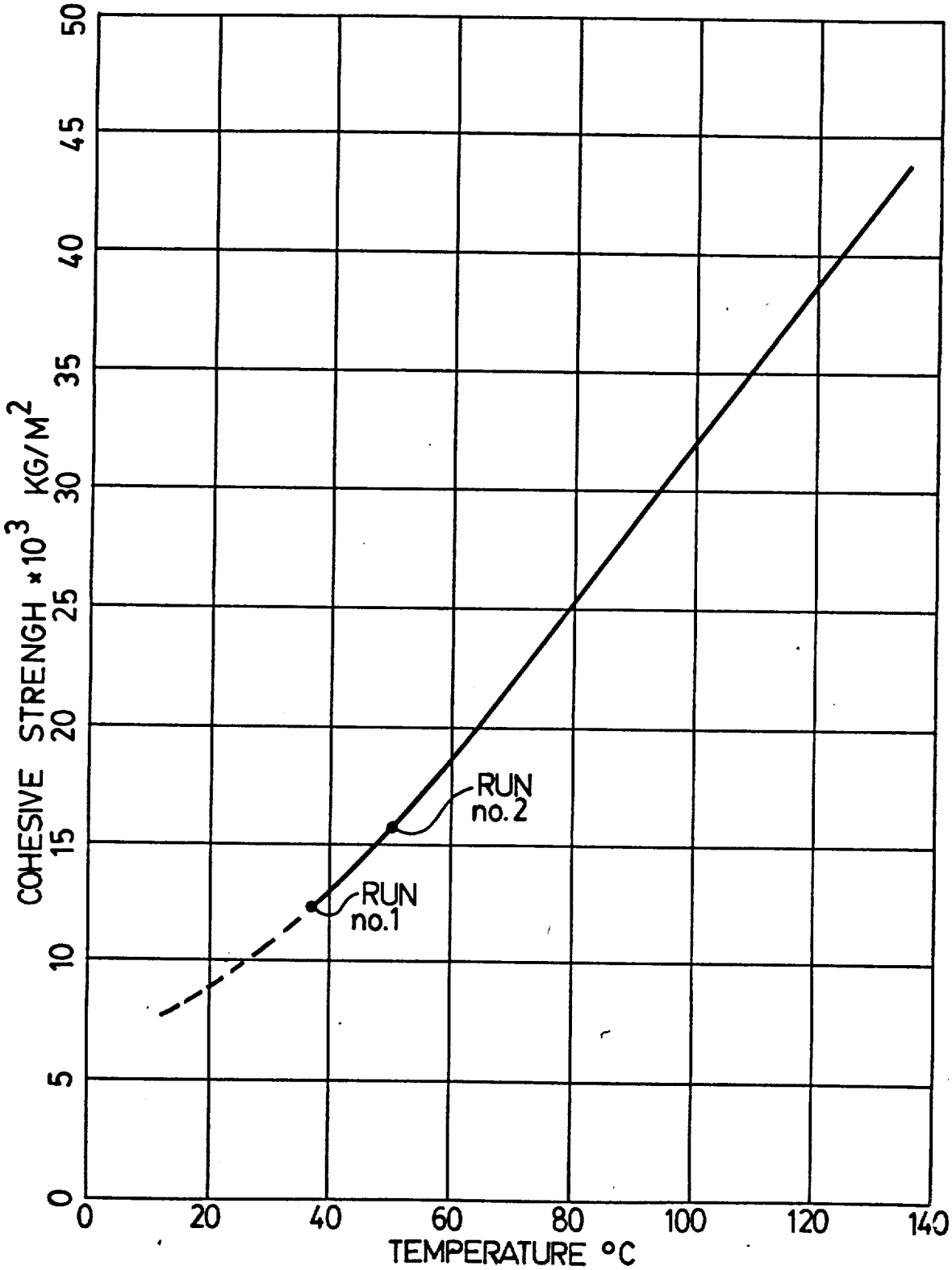
FIG. 3 is a graph of cohesive strength v heated temperature taken from test results.

The graph of FIG. 3 shows results of laboratory tests for test runs #1 and #2 conducted at 35° C. and 50° C., respectively.

In the testing, two core plugs approximately 7.62 cm in length were cut from a mounted 47.5 cm long, 3.81 cm diameter Kitscoty core sample which had been in cold storage. Two smaller 3.81 cm plugs adjacent to the sections to be tested were cut and saved as an undamaged reference.

Core material for Runs #1 and #2 was identical with the exception that Run #1 was conducted at a temperature of 35° C. and Run #2 at a temperature of 50° C.

Both cores were initially heated to test temperature and a 24 hour period was allowed to be certain that thermal equilibrium had been established. The cores were then saturated with dead oil at a low rate (approximately 5 cm$^3$/hr.) for a 48 hour period. The cores were considered saturated when effluent volume was found to match injection volume.

Air pressure was applied with ambient temperature air to the injection end of the core. An initial unsteady state period existed during which oil was displaced from the core. Once the core was at irreducible saturation, injection in Table 8 below. The initial core material was also tested as a reference.

Examination of the data of Table 8 indicates that the cohesive strength of the original core material varied from 2 441.2 to 4 882.4 kg/m$^2$. Exhaustive testing was not possible as the original core material was so unconsolidated that it fell apart after a few penetrometer tests.

The post-test sample for Run #1 had a cohesive strength varying from 5 858.9 to 12 206.1 kg/m$^2$ in the injection end and from 4 882.4 to 9 764.9 kg/m$^2$ in the middle core. This indicates that the air displacement process definitely had an effect in increasing the cohesive strength of the sample. The higher values at the injection end of the core may be attributed to the poor mobility ratio of the gas which increases channelling and might be causing poor conformance in the main body of the core.

Steady state pressure differential across the core at a flux rate of 1.87 liters/minute had a value of 0.8239 MPa.

The core plug used for test Run #2 was cut from the Kitscoty core. The mounted core had a length of 7.78 cm and a diameter of 3.81 cm. Table 7 below contains a summary of the core parameters. The core was heated to 50° C. and saturated with dead oil.

Cold (20° C.) air was displaced through the core for a 23.67 hour period. A total of 15.7 grams of oil was displaced from the core during the initial unsteady state period. This is greater than the 10.7 grams displaced in Run #1 at 35° C. The difference may be partially attributed to the reduced oil viscosity and increased gas viscosity rate was adjusted to give a flux rate of approximately 1.86 liters/minute (0.1116 $m^3$/hr.). This rate was maintained for approximately 24 hours.

Once the test was complete, total gas throughput was recorded and the core was depressured and removed from the core holder and cut into two sections. The injection half of the core was subjected penetrometer tests while the production end was kept intact. The penetrometer tests were conducted at different points on each end of the injection end of the core (i.e. the injection face and the middle of the core) to determine if the degree of consolidation varied.

Figure 2:
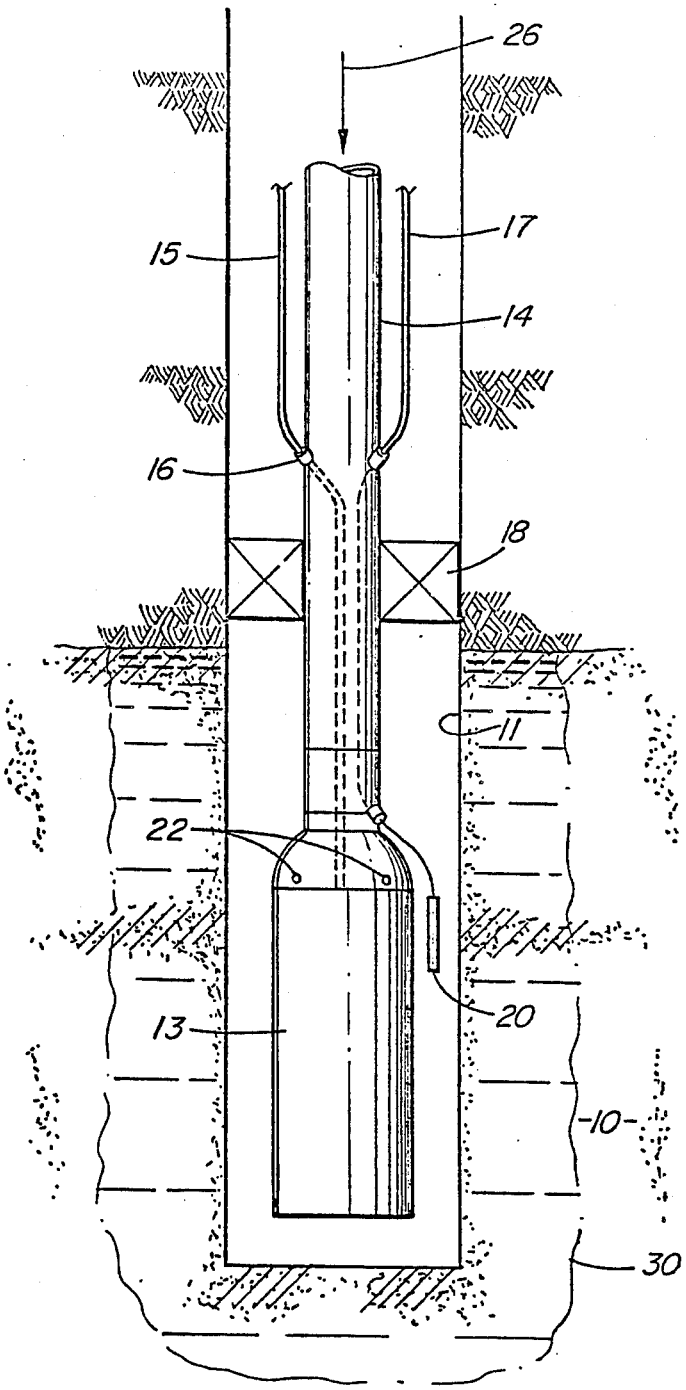
FIG. 2 is similar to FIG. 1, but shows the apparatus and borehole subsequent to the heating step.

An untested section (as seen in FIG. 2) was also subjected to penetrometer analysis to give an undamaged reference for the initial core material.

The mounted core of test Run #1 had a length of 7.62 cm and a diameter of 3.81 cm. Table 6 contains a summary of the core parameters. The core was heated to 35° C. and saturated with dead oil.

Cold (20° C.) air was displaced through the core for a 24.75 hour period. A total of 10.7 grams of oil was displaced from the core during the initial unsteady state period. Once the oil had been displaced from the core, a stable flux rate was set and had an average value of 1.87 liters/minute for the remainder of the test (1.61 liters/minute at STP of 101.3 kPa and 15.56° C.). A total of 2 635.26 liters of air were displaced through the core.

Once the test was complete, the core was cooled, removed from the core holder and cut in half. The injection end was sugjected to penetrometer tests and results are summarized at 50° C., which creates a more favorable mobility ratio and greater displacement efficiency. Once the oil has been displaced from the core, a stable flux rate was set and had an average value of 1.88 liters/minute for the remainder of the test (1.62 liters/minute at an STP of 101.3 kPa and 15.56° C.). A total of 2 747.34 liters of air (at lab conditions) were displaced through the core during the test.

Once the test was complete, the core was cooled, removed from the core holder and cut in half. The injection end was subjected to pentrometer tests and results are summarized in Table 8.

The post-test sample from Run #2 and a cohesive strength carrying from 11 717.8 to 15.623.8 kg/$m^2$ in the injection end and from 7 811.9 to 15 623.8 kg/$m^2$ in the middle of the core. This indicates that the air displacement process definitely had an effect in increasing the cohesive strength of the sample above both the initial core and 35° C. test values. The higher values at the injection end of the core may be attributed to the low mobility ratio of the gas which increases channelling and might be causing poor conformance in the main body of the core.

Steady state pressure differential across the core at a flux rate of 1.88 liters/minute had a value of 1.1583 MPa. This is greater than observed in Run #1 and may be attributed to heterogeneity in the original core material, or oxidation of the oil in the pore system and subsequent blockage to a greater degree than observed in Run #1.

The results of Runs #1 and #2 indicate that oxidation of dead oil has an effect on the cohesive strength of the sample. The magnitude of the increase of the cohesive strength is related to temperature and increases with temperature based on the results of the tests conducted to date.

TABLE 6

| RUN #1 PARAMETERS | |
|---|---|
| Core Length (cm) | 7.62 |
| Core Diameter (cm) | 3.81 |
| Temperature (°C.) | 35 |
| Run Time (hr) | 24.75 |
| Average Flux Rate at Steady State | |
| (lit/min-lab) | 1.87 |
| (lit/min-STP) | 1.61 |
| Total Oil Produced (grams) | 10.7 |
| Overburden pressure (MPa) | 7.93 |
| Steady State Pressure Differential at 1.87 lit/min air flux (MPa) | 0.8239 |
| Total Air Through Core | |
| (liters - lab) | 2635.26 |
| (liters - STP) | 2266.32 |

TABLE 7

| RUN #2 PARAMETERS | |
|---|---|
| Core Length (cm) | 7.78 |
| Core Diameter (cm) | 3.81 |
| Temperature (°C.) | 50 |
| Run Time (hr) | 23.67 |
| Average Flux Rate at Steady State | |
| (lit/min-lab) | 1.88 |
| (lit/min-STP) | 1.62 |
| Total Oil Produced (grams) | 15.7 |
| Overburden pressure (MPa) | 7.93 |
| Steady State Pressure Differential at 1.87 lit/min air flux (MPa) | 1.1583 |
| Total Air Through Core | |
| (liters - lab) | 2747.34 |
| (liters - STP) | 2362.71 |

TABLE 8

COMPARISON OF PENETROMETER TESTS

| | | Cohesive Strength | | | |
|---|---|---|---|---|---|
| | | Ton/$ft^2$ | | kg/$m^2$ | |
| Sample | Position | Min. | Max. | Min. | Max. |
| Original Pre-Test | | 0.25 | 0.5 | 2441.2 | 4882.4 |
| 35° C. Test | Injection end | 0.6 | 1.25 | 5858.9 | 12206.1 |
| 35° C. Test | Middle of core | 0.5 | 1.0 | 4882.4 | 9764.9 |
| 50° C. Test | Injection end | 1.2 | 1.6 | 11717.8 | 15623.8 |
| 50° C. Test | Middle of core | 0.8 | 1.6 | 7811.9 | 15623.8 |

Field tests have substantiated the above laboratory test results.

If the method of the present invention is utilized in a thermal complete well, the unconsolidated formation 10 surrounding the borehole 11 may be initially heated to the desired temperature by circulating steam through the borehole by injecting it through a tubing string 14, the steam injection being continued until the formation at the bottom of the borehole reaches the desired temperature, but the steam is not applied in a manner which causes it to significantly enter the formation or cause any fracturing thereof. This type of heating may somewhat reduce the oil saturation of the formation. Thus, in order to ensure sufficient oil saturation to achieve good consolidation, the steam injection maybe followed by the injection of a slug of heated oil which forms an oil bank at the bottom of the borehole. The oil bank is then squeezed into the formation in a manner which is described in more detail below. The formation is thereby resaturated with oil before proceeding with the low temperature oxidation step.

One method of heating the formation, regardless of whether the well is a thermal complete one, is that of providing an oil bank 12 in the portion of the borehole to be consolidated, and supporting a heating element 13 at the lower end of the tubing string 14. A thermal packer 18, which may be a Baker HV-1 packer, is provided immediately above the oil bank so as to close the annular space between the tubing string and outer wall of the borehole, the volume of the borehole occupied by the oil bank thus being sealed from the remainder of the borehole Electrical cables 15, which extend down the borehole, enter the tubing string 14 at a point 16 immediately above the packer, these cables supplying electrical power to the heater element 13. Electrical leads 17 also extend down the borehole to enter the tubing string above the packer 18, the leads 17 being connected to thermocouple 20 located in the oil bank 12 whereby the temperature of the oil bank may be noted above the ground and utilized in controlling the heating element 13. The tubing string is provided with openings 22 (FIG. 2) below the packer, 18 and initially these holes are plugged with pressure shear pins 23 (FIG. 1) which are adapted to blow when a predetermined pressure is developed within the tubing string. The pins may be rated, for example, as 6300 kPa shear pins.

The presences of the oil bank allows efficient transfer of heat from the heating element to the formation; and after the formation is heated in accordance with calculations for temperature and time, as described above, the tubing string 14 is raised to a pressure required to blow the shear pins 23. The pressure may be raised by injecting an inert gas which does not react with the oil bank, such as nitrogen into the tubing string 14, as indicated by arrow 25 (FIG. 1). When the shear pins 23 have been blown, the pressure of nitrogen is maintained so that it flows from openings 22 into the volume occupied by the oil bank and forces the oil bank to flow back into the heated formation 10 and provides a highly saturated area 30 around the borehole. Once the oil has been completely evacuated from the borehole, air which as been simply compressed at the surface, but not heated, is injected into the tubing string as indicated by arrow 26 (FIG. 2) for a time period which has been predetermined. It has been found that the rate of asphaltenes precipitation is relatively independent of the rate of air injection but more dependent on the temperature of the formation.

It is important that the oil which is utilized for the oil bank has the same characteristics of the oil taken from the formation for testing prior to the commencement of the treatment. However, it is believed that it is possible to use a relatively heavy oil in the oil bank in a situation where the oil in the formation is relatively light, and to calculate the amount of heating on the basis of the characteristics of the heavy oil and then having forced the heated heavy oil into the formation carrying out the air injection for a duration again established on the basis of the characteristics of the heavy oil used in the oil bank. Thus, in a situation where a well is producing light oil, say 40 API for example, and sand problems are experienced, the sand in the flow can be controlled by consolidating the surrounding formation using the process of the present invention.

In one in-well test conducted at Kitscoty 1A-22 well in accordance with the present invention, the well was continuing to produce at a rate up to 6 $M^3/D$ 9 months after the consolidation treatment, whereas before the treatment the well would sand up in 6 hours. In another treated well, Christina Lake 10-14MM, production was possible with only approximately 1% sand, whereas well 6–7 in a nearby thermal test had significant sand problems.

A preferred method of the present invention which has been found to be very economical and effective in a borehole of a primary well involves heating a quantity of heavy crude oil above the ground surface, such as volume not exceeding 50 $m^3$, to approximately 100° C. and then injecting the heated oil into the borehole surrounding vicinity to a depth of 3 to 6 inches so as to raise the temperature to a temperature of at least 35° C. to 50° C. This is followed by a low flux of air for approximately 48 hours. This method has resulted in satisfactory consolidation of the formation when a volume of from 40 to 50 $m^3$ is injected into a borehole of approximately 500 meters to raise the temperature of borehole surrounding vicinity to a temperature between 35° C. and 50° C. For boreholes of different sizes, the temperature of the borehole vicinity can be tested and sufficiently heated heavy crude oil injected to reach the 35° C. temperature.

The above described method of injecting the heated crude has the advantage that equipment of existing service companies can be readily adapted to carry out the method.

It can be seen, therefore, that when low temperature oxidation is carried out in accordance with the present invention, the abrasive action which results from the use of a combination of air and steam in known processes is avoided so that a well consolidated formation is provided. The permeability characteristics are believed superior to other known processes which utilize high heat and depend upon combustion within the formation. The process of the present invention is economical to carry out because the heating is efficient, particularly when an oil bank is used to provide good conductivity to the formation. The process is feasible for wells which are not thermal completed and no equipment which is not readily available is required. Very little energy is expended in injecting the air because the air is not heated and only a low flow rate of air is required.

What I claim is:

1. A method of treating an unconsolidated formation surrounding a borehole to form a permeable consolidated formation, the method consisting essentially of the steps of:

(A) heating the unconsolidated formation adjacent said borehole to a temperature in the range of 35° C. to 135° C. sufficient to support low temperature oxidation of oil contained within said formation without relying on high injection pressure or fracture of the formation, then (B) injecting unheated oxygen-containing gas into the borehole and into contact with said heated formation for a predetermined time to consolidate the formation by way of the precipitation of asphaltenes in said formation, such injection being carried out at a low volume rate to avoid fracturing of the formation.

2. The method of claim 1 wherein said oxygen-containing gas is air.

3. The method of claim 1 wherein said formation is heated to a depth of approximately 6 inches around the borehole.

4. The method of claim 1 or 2 in which, such heating of the formation is carried out by heating heavy crude oil above the ground surface to about 100° C. and injecting such heated crude oil into the borehole surrounding vicinty to a depth of 3 to 6 inches to heat such formation to a temperature of at least 35° C. to 50° C.

5. The method of claim 4 in which about 40 to 50 cubic meters of crude oil are heated for a borehole having a depth of about 500 meters.

6. The method of claim 2 wherein an electric heater is inserted into a bank of oil occupying the portion of the borehole requiring treatment to carry out such heating step (A), the oil being heated to a predetermined temperature by said heater.

7. The method of claim 6 wherein said bank of oil is forced into said formation after being heated for a predetermined time by said heater.

8. The method of claim 7 wherein, in carrying out such heating step (A), an inert gas is injected under pressure into said borehole for forcing said oil into said formation.

9. The method of claim 8 wherein the inert gas is nitrogen.

10. The method of claim 6 wherein said oil in said oil bank has the same characteristics as the oil naturally occupying the formation being treated.

11. In treating an unconsolidated sand formation surrounding a well borehole, a method for forming a permeable consolidated formation consisting essentially of the steps of:

maintaining an oil bank in the portion of the borehole to be treated, operating an electric heater in said oil bank to heat said unconsolidated formation to a predetermined temperature for a predetermined depth away from said borehole, forcing the oil of said oil bank from said borehole and into the surrounding formation; and then injecting air at substantially atmospheric temperature without relying on high injection pressures into contact with the heated formation for a predetermined time to thereby precipitate asphaltenes in said formation and thereby form a permeable consolidated zone in the vicinity of the well.

12. The method of claim 11 wherein the oil in said oil bank has the same characteristics of the oil naturally occupying the formation being treated.

13. The method of claim 11 wherein said oil is tested prior to injection into said borehole to establish the optimum formation temperature and air injection time for precipitation of sufficient asphaltenes by way of low temperature oxidation to achieve the consolidation of said formation.

14. The method of claim 11 including supporting said electric heater in said oil bank at the lower end of a tubing string and sealing the annular area surrounding the tubing string and above said oil bank by a thermal packer.

15. The method of claim 14, including providing said tubing string below said packer with openings containing pressure shear pins, and subsequent to the heating step, raising the pressure in said string tubing to a predetermined level to operate said shear pins to open said openings and thereby admit pressurized gas into said oil bank.

16. The method of claim 11 wherein the oil bank is exposed to pressurized nitrogen to force the oil into formation.

17. The method of claim 15 wherein pressurized nitrogen is injected into said tubing string to operate said shear pins and to then flow into said borehole below said thermal packer and thereby force the oil from said oil bank into said formation.

18. The method of claim 17 wherein the air at substantially atmospheric temperature is injected into the borehole below said thermal packer via the tubing string after the evacuation of the oil bank, said air being injected at a pressure below fracturing pressure.

19. A method of treating a formation surrounding a borehole of a well producing oil at approximately 40 API or less, the method consisting essentially of the steps of:

obtaining a supply of heavy oil and testing said supply to establish an optimum temperature to achieve low temperature oxidation of the heavy oil;

injecting said heavy oil into said borehole to provide an oil bank occupying the portion of said borehole surrounded by said formation;

operating a heater in said oil bank to heat said formation to a predetermined temperature for a predetermined depth away from said borehole;

injecting an inert gas into said borehole at a pressure sufficient to force said oil bank into said formation; and then injecting air at substantially atmospheric temperature without relying on high injection pressures into contact with the heated formation for a predetermined time to thereby precipitate asphaltenes from the heavy oil in said formation so as to form a permeable consolidated zone in the vicinity of said borehole.

* * * * *

UNITED STATES PATENT OFFICE

CERTIFICATE OF CORRECTION

Patent No. 4,703,800 Dated November 3, 1987

Inventor(s) Mohsen R. Hanna

It is certified that error appears in the above-identified patent and that said Letters Patent are hereby corrected as shown below:

Columns 5 and 6, TABLE 2, the columns under STACK NO. 5 should be as follows:

under SAMPLE NO., delete "0.039";
under AVERAGE BULK, delete "2.41" and insert --0.039--;
under PERMEABILITY, delete "24.4" and insert --2.41--;
under POROSITY, delete "600.97-603.3" and insert --24.4--;
under CORE DEPTH, insert --600.97-603.3--.

Column 8, line 7, "highercohesive" should be --higher cohesive--;

line 49, after "injection", insert --rate was adjusted to give a flux rate of approximately 1.86 liters/minute (0.1116 $m^3$/hr.). This rate was maintained for approximately 24 hours.

Once the test was complete, total gas throughput was recorded and the core was depressured and removed from the core holder and cut into two sections. The injection half of the core was subjected to penetrometer tests while the production end was kept intact. The penetrometer tests were conducted at different points on each end of the injection end of the core (i.e. the injection face and the middle of the core) to determine if the degree of consolidation varied.

UNITED STATES PATENT OFFICE

CERTIFICATE OF CORRECTION

Patent No. 4,703,800 Dated November 3, 1987

Inventor(s) Mohsen R. Hanna

It is certified that error appears in the above-identified patent and that said Letters Patent are hereby corrected as shown below:

An untested section (as seen in Figure 2) was also subjected to penetrometer analysis to give an undamaged reference for the initial core material.

The mounted core of test Run #1 had a length of 7.62 cm and a diameter of 3.81 cm. Table 6 contains a summary of the core parameters. The core was heated to 35°C. and saturated with dead oil.

Cold (20°C.) air was displaced through the core for a 24.75 hour period. A total of 10.7 grams of oil was displaced from the core during the initial unsteady state period. Once the oil had been displaced from the core, a stable flux rate was set and had an average value of 1.87 liters/minute for the remainder of the test (1.61 liters/minute at STP of 101.3 kPa and 15.56°C.). A total of 2 635.26 liters of air were displaced through the core.

Once the test was complete, the core was cooled, removed from the core holder and cut in half. The injection end was subjected to penetrometer tests and results are summarized--.

UNITED STATES PATENT OFFICE

CERTIFICATE OF CORRECTION

Patent No. 4,703,800 Dated November 3, 1987

Inventor(s) Mohsen R. Hanna

It is certified that error appears in the above-identified patent and that said Letters Patent are hereby corrected as shown below:

Column 9, line 12, after "cosity", cancel the entire line;
cancel lines 13 through 41;
line 42, cancel "results are summarized".

Column 11, line 1, "maybe" should be --may be--.

Signed and Sealed this

Nineteenth Day of April, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,703,800

DATED : November 3, 1987

INVENTOR(S) : Mohsen R. Hanna

It is certified that error appears in the above-indentified patent and that said Letters Patent is hereby corrected as shown below:

The sheet of drawing consisting of figure 3, should be added as shown on the attached page.

Signed and Sealed this

Twenty-eighth Day of June, 1994

Bruce Lehman

*Attest:*

BRUCE LEHMAN

*Attesting Officer*

*Commissioner of Patents and Trademarks*